United States Patent [19]

Dilks, Jr. et al.

[11] 4,285,809

[45] Aug. 25, 1981

[54] ROTOR FOR SEDIMENTATION FIELD FLOW FRACTIONATION

[75] Inventors: Charles H. Dilks, Jr., Newark; Joseph J. Kirkland, Wilmington; Wallace W. Yau, Newark, all of Del.

[73] Assignee: E. I. Du Pont de Nemours and Company, Wilmington, Del.

[21] Appl. No.: 125,853

[22] Filed: Feb. 29, 1980

[51] Int. Cl.[3] ..... B03B 5/00

[52] U.S. Cl. ..... 209/155; 73/432 PS; 233/27

[58] Field of Search ..... 209/1, 155, 208, 444, 209/453, 11; 55/67, 81; 73/432 PS, 23.1; 210/198 C, 72; 233/1 R, 1 A, 1 D, 14 R, 23 R, 25, 26, 27

[56] References Cited

U.S. PATENT DOCUMENTS 2,920,478 1/1960 Golay ..... 73/23.1

4,066,536 1/1978 Ball et al. ..... 209/155

FOREIGN PATENT DOCUMENTS 2821056 12/1978 Fed. Rep. of Germany ..... 233/27

OTHER PUBLICATIONS

Giddings et al., "Sedimentation Field-Flow Fractionation", Analytical Chemistry, vol. 46, No. 13, Nov. 1974, pp. 1917–1924.

*Primary Examiner*—Ralph J. Hill

[57] ABSTRACT

A long, thin annular belt-like channel is designed for use in sedimentation field flow fractionation. The channel has a generally rectangular cross section and a width to thickness aspect ratio lying in the range of 3–50 to 1. The channel may be formed of a flattened capillary tube. The ratio of the thickness of the channel to the characteristic height of the particles to be separated is greater than 5 to 1.

6 Claims, 4 Drawing Figures

Computer
10
12
14
16
18
20
22
23
26
27
28
30
31
32
33
34
36
38
40
42
43
44
46
50
52
54
60
62
64
W
B
A

ROTOR FOR SEDIMENTATION FIELD FLOW FRACTIONATION

CROSS REFERENCE TO RELATED APPLICATIONS

This application is related to inventions described in copending applications Ser. No. 125,855, filed Feb. 29, 1980, entitled "Rotor for Sedimentation Field Flow Fractionation", by John Wallace Grant; Ser. No. 125,854, filed Feb. 29, 1980, entitled "Drive for Rotating Seal", by Charles Heritage Dilks, Jr.; Ser. No. 125,852, filed Feb. 29, 1980, entitled "Apparatus for Field Flow Fractionation", by John Wallace Grant, Joseph Jack Kirkland and Wallace Wen-Chuan Yau; Ser. No. 125,851, filed Feb. 29, 1980, entitled "Method and Apparatus for Field Flow Fractionation", by Joseph Jack Kirkland and Wallace Wen-Chuan Yau; and Ser. No. 125,850, filed Feb. 29, 1980, entitled "Rotor for Sedimentation Field Flow Fractionation", by John Wallace Grant.

BACKGROUND OF THE INVENTION

Sedimentation field flow frctionation is a versatile technique for the high resolution separation of a wide variety of particulates suspended in a fluid medium. The particulates include macromolecules in the $10^5$ to $10^{13}$ molecular weight (0.001 to 1 $\mu$m) range, colloids, particles, unicelles, organelles and the like. The technique is more explicitly described in U.S. Pat. No. 3,449,938, issued June 17, 1969 to John C. Giddings and U.S. Pat. No. 3,523,610, issued August 11, 1970 to Edward M. Purcell and Howard C. Berg.

Field flow fractionation is the result of the differential migration rate of components in a carrier or mobile phase in a manner similar to that of chromatography. However, in field flow fractionation there is no separate stationary phase as is in the case of chromatography. Sample retention is caused by the redistribution of sample components between the fast to the slow moving strata within the mobile phase. Thus, particulates elute more slowly than the solvent front. Typically a field flow fractionation channel consisting of two closely spaced parallel surfaces is used. A mobile phase is caused to flow continuously through the gap between the surfaces. Because of the narrowness of this gap or channel (typically 0.025 centimeters (cm)) the mobile phase flow is laminar with a characteristic parabolic velocity profile. The flow velocity is the highest at the middle of the channel and the lowest near the two channel surfaces.

An external force field of some type (the force fields include gravitational, thermal, electrical, fluid cross-flow and others as described variously by Giddings and Berg and Purcell), is applied transversely (perpendicular) to the channel surfaces or walls. This force field pushes the sample components in the direction of the slower moving liquid strata near the outer wall. The buildup of sample concentration near the wall, however, is resisted by the normal diffusion of the particulates in a direction opposite to the force field. This results in a dynamic layer of component particles, each component with an exponential—concentration profile. The extent of retention is determined by the particulate's time-average position within the concentration profile, which is a function of the balance between the applied field strength and the opposing tendency of particles to diffuse.

In sedimentation field flow fractionation, use is made of a centrifuge to establish the force field required for the separation. For this purpose a long, thin annular belt-like channel is made to rotate within a centrifuge. The resultant centrifugal force causes components of higher density than the mobile phase to settle toward the outer wall of the channel. For equal particle density, because of their higher diffusion rate, smaller particulates will accumulate into a thicker layer against the outer wall than will larger particles. On the average, therefore, larger particulates are forced closer to the outer wall.

If now the fluid medium, which may be termed a mobile phase or solvent is fed continuously in one end of the channel, it carries the sample components through the channel for later detection at the outlet of the channel. Because of the shape of the laminar velocity profile within the channel and the placement of particulates in that profile, solvent flow causes smaller particulates to elute first, followed by a continuous elution of sample components in the order of ascending particulate mass.

As a general rule relatively long channels are required in many separations. Unfortunately, however, when Giddings et al. (J. C. Giddings, F. J. F. Yang, and M. N. Myers, Anal. Chem. 46, 1917 (1974)) tried such a long column using a coiled tubing, they failed apparently because the circular cross-section incurred secondary flow effects. Secondary flow is a component of flow that is normal to the column axis of a curved tube, and is induced by the increased centrifugal force experienced by fluid moving in the fast flow stream lines. Because of this effect there is a continuous recirculation of liquid within the tubing and if it is sufficiently strong, it recirculates the component peak causing a loss of retention and relatively large increases in band spreading. Giddings et al. propose that this secondary effect can be reduced by utilizing columns with a rectangular cross-section and having a large width to thickness ratio. Because of this early teaching, previous sedimentation field flow fractionations have been carried out using channels with a large width to thickness aspect ratio typically in a range of 50 to 200 to 1.

Channels having such large aspect width to thickness ratios increase the volume of fluid medium required to flow through the channel and decrease detection sensitivity since sample peaks can become diluted because of the large fluid volumes.

SUMMARY OF THE INVENTION

According to one aspect of this invention, an apparatus is constructed for separating particulates suspended in a fluid medium according to their effective masses, said apparatus having an annular cylindrical channel with a cylinder axis, means for rotating said channel about said axis, means for passing said fluid medium circumferentially through said channel, and means for introducing said particulates into said medium for passage through said channel, the improvement wherein said channel is generally rectangular in cross-section and has a width to thickness aspect ratio lying the range 3–50 to 1. Preferably this aspect ratio should lie in the range 10–50 to 1. Channels having these relatively lower aspect ratios provide many advantages or retain the previously known advantages of higher resolution and better separations provided by channels that can be made in longer lengths. Also, such channels decrease the solvents required for a separation and they enhance detection sensitivity by reducing the dilution of the sample peak.

In preferred aspects of this invention, channels having relatively low aspect ratios can be formed using capillary tubing which has been flattened to provide a cross-section whose ends are rounded. It has been found that with channels of this type, having a ratio of thickness to the characteristic height of the particulates to be separated of greater than 5 to 1 performed satisfactorily. As long as this characteristic height ratio is maintained, the lower aspect ratios of the channel is not critical.

BRIEF DESCRIPTION OF THE DRAWINGS

Further advantages and features of this invention will become apparent from the following description wherein.

DETAILED DESCRIPTION OF THE PREFERRED EMBODIMENT

Figures 1, 2, 3, 4:
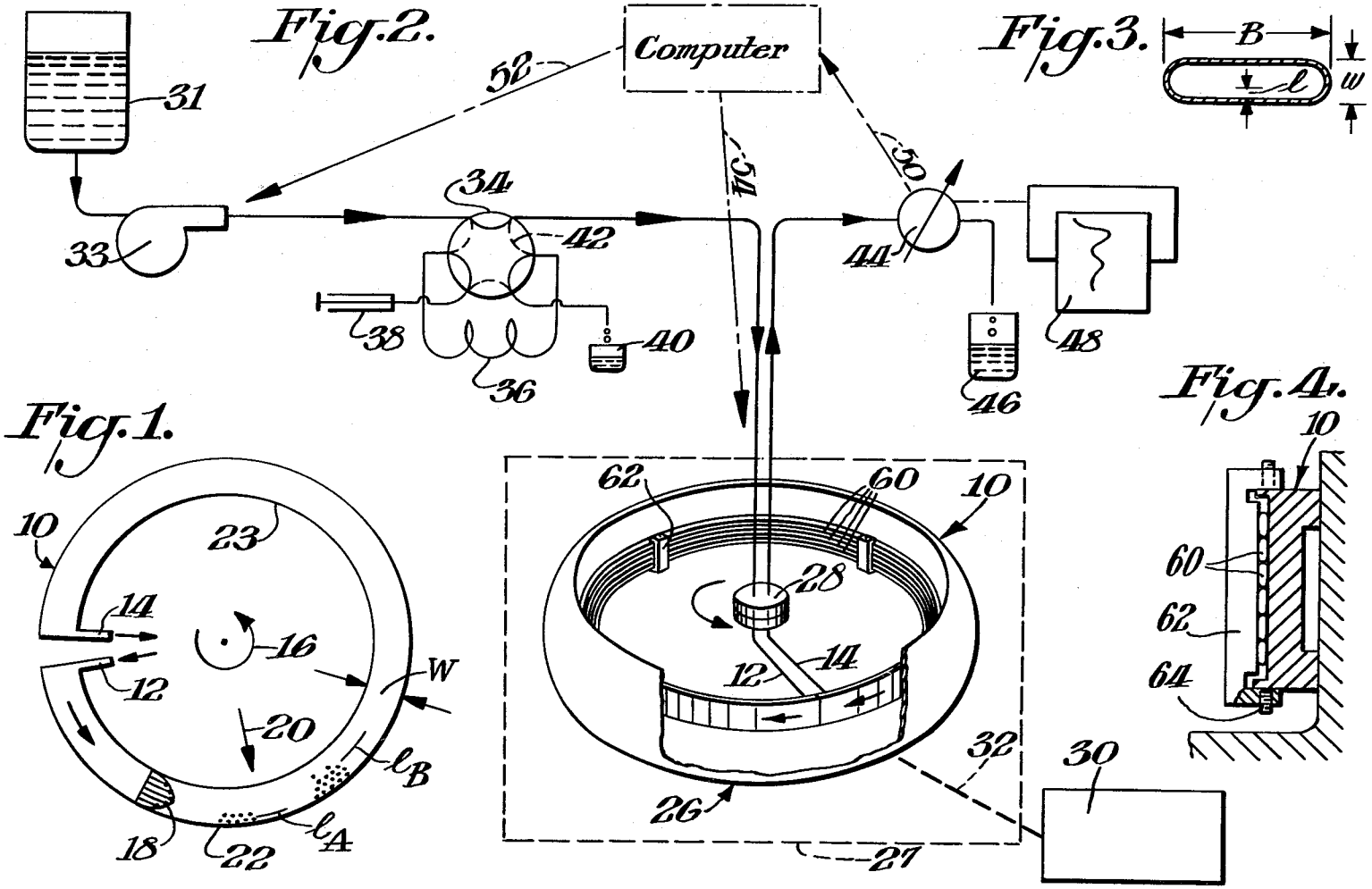
FIG. 1 is a simplified schematic representation of the sedimentation field flow fractionation technique.
FIG. 2 is a partially schematic, partially pictorial representation of a particle separation apparatus constructed in accordance with this invention.
FIG. 3 is a cross-section of a capillary channel constructed in accordance with this invention.
FIG. 4 is a cross-section of a flow channel depicting how a capillary channel may be mounted.

The principles of operation of a typical sedimentation field flow fractionation apparatus with which this invention may find use are more easily understood with reference to FIGS. 1 and 2. In FIG. 1 there may be seen an annular ringlike (beltlike or ribbonlike) channel 10 having a relatively small thickness (in the radial dimension) designated W. The channel has an inlet 12 in which the fluid medium (hereinafter referred to as the mobile phase, liquid or simply fluid) is introduced together with, at some point in time, a small sample of a particulate to be fractionated, and an outlet 14. The annular channel is spun in either direction. For purposes of illustration the channel is illustrated as being rotated in a counterclockwise direction denoted by the arrow 16. Typically, the thickness of these channels may be in the order of magnitude of 0.025 cm; actually, the smaller channel thickness the greater the rate at which separations can be achieved.

In any event, because of the thin channel, fluid flow is laminar and assumes a parabolic flow velocity profile across the channel thickness, as denoted by the reference numeral 18. The channel 10 is defined by an outer surface or wall 22 and an inner surface or wall 23. If now a radial centrifugal force field, denoted by the arrow 20, is impressed transversely, that is at right angles to the channel, particulates are compressed into a dynamic cloud with an exponential concentration profile, whose average (or characteristic) height or distance from the outer wall 22 is determined by the equilibrium between the average force exerted on each particulate by the field and by normal opposing diffusion forces due to Brownian motion. Because the particulates are in constant motion at any given moment, any given particulate can be found at any distance from the wall. Over a long period of time compared to the diffusion time, every particulate in the cloud will have been at every different height from the wall many times. However, the average height from the wall of all of the individual particulates of a given mass over that time period will be the same. Thus, the average height of the particulates from the wall will depend on the mass of the particulates, larger particulates having an average height $\mathbf{1}_a$ (FIG. 1) and that is less than that of smaller particulates $\mathbf{1}_b$ (FIG. 1).

The fluid in the channel is now caused to flow at a uniform speed, and the fluid is established in the parabolic profile of flow 18. In this laminar flow situation, the closer a liquid layer is to the wall, the slower it flows. During the interaction of the compressed cloud of particulates with the flowing fluid, sufficiently large particulates will interact with strata of fluid whose average speed will be less than the maximum for the entire liquid flow in the channel. These particulates then can be said to be retained or retarded by the field or to show a delayed elution in the field. This mechanism is described by Berg and Purcell in their article entitled "A Method For Separating According to Mass a Mixture of Macromolecules or Small Particles Suspended in a Fluid", I-Theory, by Howard C. Berg and Edward M. Purcell, Proceedings of the National Academy of Sciences, Vol. 58, No. 3, pages 862–869, Sept. 1967.

According to Berg and Purcell, a mixture of macromolecules or small particulates suspended in a fluid may be separated according to mass, or more precisely what may be termed effective mass, that is, the mass of a particulate minus the mass of the fluid it displaces. If the particulates are suspended in the flowing fluid, they distribute themselves in equilibrium "atmospheres" whose scale heights, 1, depend on the effective masses, Me, through the familiar relation $M_e a = kT$. In this relationship k is Boltzman's constant, T is the absolute temperature, and a is the centrifugal acceleration. In view of this differential transit time of the particulates through a relatively long column or channel, the particulates become separated in time and elute at different times. Thus, as may be seen in FIG. 1, a cluster of relatively small particulates $\mathbf{1}_b$ is ahead of and elutes first from the channel, whereas a cluster of larger, heavier paticulates $\mathbf{1}_a$ is noticed to be distributed more closely to the outer wall 22 and obviously being subjected to the slower moving components of the fluid flow will elute at a later point in time.

In accordance with this invention channels are constructed having a generally rectangular cross-section and a width to thickness ratio lying in the range of 3–50 to 1. Preferably the ratio range is 10–50 to 1. The channels may be constructed utilizing a continuously welded annular ring or the split-ring as is described, for example, in the said first cited Grant copending application. This lesser aspect ratio is permitted since the determining parameter in sedimentation field flow fractionation separations is the ratio of the thickness of the channel to the 1 value which as described above as the characteristic height of the particles to be separated, or more specifically, is the equivalent mean height of the exponential concentration of the particle cluster from the wall. Since this 1 value is not a function of channel thickness, conformation of the channel is not critical as long as the ratio of the thickness W of the channel to the 1 value (FIG. 3) is larger than some minimum value preferablly 5 to 1. Channels having the dimension of 0.1–0.5 cm wide and 0.005–0.15 cm thick are generally preferred, however, it is understood that these preferred dimensions are by way of preference and not to be considered as limiting in any way. Such channels would have an aspect ratio of about 3–20 to 1.

In in alternative embodiment of this invention, channels may be constructed of flattened stainless steel tubing having a relatively low width B to thickness W ratio, for example from about 3–50 to 1. Channels have been constructed of flattened stainless steel tubing of 0.04 inches by 0.125 inches with lengths of about 4 meters. Since band broadening can be a problem if channel thickness is large, narrower channels made of capillary tubing are preferred. Such a channel is shown particularly in FIGS. 3 and 4. An alternative mounting of a capillary channel is depicted in FIG. 2. This channel can be constructed by a particularly unique method by selecting a piece of ⅛ inch O.D. by 0.01 inch wall thickness stainless steel tubing, by filling it with water, sealing it, and squeezing the tube down to a rectangular cross-section configuration while it is being coiled. This unit may then be mounted within the rotor described, for example, in of FIG. 2 without further modification.

The advantages of using these capillary and other channels having a relatively low aspect ratio is that they can be prepared with greater length which permits higher resolution and better separations and yet reduce significantly the volume of fluid medium used as a solvent as compared to channels with commonly used large aspect ratios. Further, the channels of this invention enhance detection sensitivity by reducing the dilution of the sample peak, and they are of relatively low cost and easy to fabricate.

These channels may be used and mounted in the rotor of a system constructed in accordance with this invention, as depicted in FIG. 2. In this figure, the channel 10 may be, as described above, welded or split ring, or other configuration having the aspect ratio noted. This channel is disposed in a bowl-like or ringlike rotor 26 for support. The rotor 26 may be part of a conventional centrifuge, denoted by the dashed block 28, which includes a suitable centrifuge drive 30 of a known type operating through a suitable linkage 32, also a known type, which may be direct belt or gear drive. Although a bowl-like rotor is illustrated, it is to be understood that the channel 10 may be supported by rotation about its own cylinder axis by any suitable means such as a spider (not shown) or simple ring.

In the case of capillary channels, the cioled, flattened capillary tubing 60, formed as described above, may be placed against the inner wall of the channel 10 (FIG. 4). Several U-shaped clamps 62 are secured thereover, with the ends of the U's secured to the top and bottom of the inner wall of the channel 10 as by set screws 64.

The channel has a liquid or fluid inlet 12 and an outlet 14 which is coupled through a rotating seal 28 of conventional design to the stationary apparatus which comprise the rest of the system. Thus the inlet fluid (or liquid) or mobile phase of the system is derived from suitable solvent reservoirs 30 which are coupled through a conventional pump 32 thence through a two-way, 6-port sampling valve 34 of conventional design through a rotating seal 28, also of conventional design, to the inlet 12.

Samples whose particulates are to be separated are introduced into the flowing fluid stream by this conventional sampling valve 34 in which a sample loop 36 has either end connected to opposite ports of the valve 34 with a syringe 38 being coupled to an adjoining port. An exhaust or waste receptacle 40 is coupled to the final port. When the sample valve 34 is in the position illustrated by the solid lines, sample fluid may be introduced into the sample loop 36 with sample flowing through the sample loop to the exhaust receptacle 40. Fluid from the solvent reservoirs 30 in the meantime flows directly through the sample valve 34. When the sample valve 34 is changed to a second position, depicted by the dashed lines 42, the ports move one position such that the fluid stream from the reservoir 30 now flows through the sample loop 36 before flowing to the rotating seal 28. Conversely, the syringe 38 is coupled directly to the exhaust reservoir 40. Thus the sample is carried by the fluid stream to the rotating seal 28.

The outlet line 14 from the channel 10 is coupled through the rotating seal 28 to a conventional detector 44 and thence to an exhaust or collection receptacle 46. The detector may be any of the conventional types, such as an ultraviolet absorption or a light scattering detector. In any event, the analog electrical output of this detector may be connected as desired to a suitable recorder 48 of known type and in addition may be connected as denoted by the dashed line 50 to a suitable computer for analyzing this data. At the same time this system may be automated if desired by allowing the computer using known techniques, to control the operation of the pump 32 and also the operation of the centrifuge 28. Such control is depicted by the dashed lines 52 and 54, respectively.

There has thus been described a relatively simple system of permitting relatively long flow channels in sedimentation field flow fractionation having low aspect ratios which produce the many noted advantages.

We claim:

1. An apparatus for separating particulates suspended in a fluid medium according to their effective masses, said apparatus having an annular cylindrical channel with a cylinder axis, said channel being sufficiently thin in the radial dimension to effect laminar flow therein, means for rotating said channel about said axis, means for passing said fluid medium circumferentially through said channel, and means for introducing said particulates into said medium for passage through said channel, the improvement wherein said channel is generally rectangular in crosssection and has a width to thickness aspect ratio lying in the range 3–50 to 1.

2. An apparatus of claim 1 wherein said aspect ratio lies in the range of 3–20 to 1.

3. An apparatus of claim 1 or 2 wherein the ratio of the thickness of said channel to the characteristic height of the particulates to be separated is greater than 5 to 1.

4. An apparatus of claim 1 or 2 wherein said channel is formed of a flattened capillary tube.

5. An apparatus of claim 4 wherein said channel is formed of a flattened capillary tube and the rectangular cross-section of said channel has rounded end sections.

6. An apparatus of claim 5 wherein said channel is formed of a flattened capillary tube and the rectangular cross-section of said channel has rounded end sections and the ratio of the thickness of said channel to the characteristic height of the particulates to be separated is greater than 5 to 1.

* * * * *

UNITED STATES PATENT OFFICE

CERTIFICATE OF CORRECTION

PATENT NO. : 4,285,809

DATED : August 25, 1981

INVENTOR(S) : CHARLES HERITAGE DILKS, JR., JOSEPH JACK KIRKLAND and WALLACE WEN-CHUAN YAU It is certified that error appears in the above-identified patent and that said Letters Patent are hereby corrected as shown below:

Please change, in the Title, the word "ROTOR" to --CHANNEL--.

Signed and Sealed this

First Day of December 1981

[SEAL]

*Attest:*

GERALD J. MOSSINGHOFF

*Attesting Officer*

*Commissioner of Patents and Trademarks*